US010008768B2

(12) United States Patent
Markof et al.

(10) Patent No.: US 10,008,768 B2
(45) Date of Patent: Jun. 26, 2018

(54) CAPACITIVELY SHIELDED HOUSING, IN PARTICULAR CAPACITIVELY SHIELDED COMPONENT HOUSING FOR AN ANTENNA DEVICE

(71) Applicant: KATHREIN-WERKE KG, Rosenheim (DE)

(72) Inventors: Mathias Markof, Assling (DE); Anian Gasteiger, Brannenburg (DE); Klaus Rothbächer, Traunreut (DE); Andreas Jürgens, Rosenheim (DE); Christoph Staita, Brannenburg (DE); Philipp Ponn, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days. days.

(21) Appl. No.: 15/500,742

(22) PCT Filed: Jul. 16, 2015

(86) PCT No.: PCT/EP2015/001465
§ 371 (c)(1),
(2) Date: Jan. 31, 2017

(87) PCT Pub. No.: WO2016/015835
PCT Pub. Date: Feb. 4, 2016

(65) Prior Publication Data

US 2017/0222313 A1 Aug. 3, 2017

(30) Foreign Application Priority Data

Jul. 31, 2014 (DE) ..... 10 2014 011 514

(51) Int. Cl.
*H01Q 1/24* (2006.01)
*H01Q 1/42* (2006.01)
(Continued)

(52) U.S. Cl.
CPC ..... *H01Q 1/42* (2013.01); *H01Q 1/246* (2013.01); *H01Q 19/10* (2013.01); *H01Q 21/26* (2013.01)

(58) Field of Classification Search
CPC ..... H01Q 1/24; H01Q 1/246; H01Q 1/42; H01Q 19/10; H01Q 21/26
See application file for complete search history.

(56) References Cited

U.S. PATENT DOCUMENTS 6,392,600 B1 5/2002 Carson et al.
7,245,267 B2 * 7/2007 Gottl ..... H01Q 1/246 343/702

(Continued)

FOREIGN PATENT DOCUMENTS

DE 20 2009 001 821 4/2009
DE 10 2013 007 838 7/2014

(Continued)

OTHER PUBLICATIONS

English translation of the International Preliminary Report on Patentability and Written Opinion of the International Searching Authority dated Feb. 9, 2017, issued in International Application No. PCT/EP2015/001465.

(Continued)

*Primary Examiner* — Hoang Nguyen
(74) *Attorney, Agent, or Firm* — Nixon Vanderhye P.C.

(57) ABSTRACT

An electrically capacitively shielded component housing for a mobile radio antenna has an opening region which is shielded with respect to HF radiation by a shielding cover or plate. The contact or anchoring cover segments of the shielding cover or plate are arranged against the component and/or reflector housing immediately adjacent to and in parallel with the contact or anchoring housing segments. An insulating layer is interposed, and the planar contact or anchoring housing segments and the planar contact or (Continued)

anchoring cover segments are oriented parallel to or at an angle to an insertion or mounting direction (E) and/or a central axis (Z) extending through the component and/or reflector housing, at an angle $\alpha$ where $0° \leq \alpha < 90°$.

14 Claims, 10 Drawing Sheets

(51) Int. Cl.
*H01Q 19/10* (2006.01)
*H01Q 21/26* (2006.01)

(56) References Cited

U.S. PATENT DOCUMENTS

| | | | | |
|---|---|---|---|---|
| 2010/0013729 | A1 | 1/2010 | Harel et al. | |
| 2012/0280882 | A1 | 11/2012 | Zimmerman et al. | |
| 2014/0062826 | A1* | 3/2014 | Jonsson ..... | H01Q 1/246 343/836 |

FOREIGN PATENT DOCUMENTS

| | | |
|---|---|---|
| DE | 20 2013 010 641 | 1/2015 |
| WO | WO 2013/033894 | 3/2013 |
| WO | WO 2013/096880 | 6/2013 |

OTHER PUBLICATIONS

International Search Report and Written Opinion of the ISA for PCT/EP2015/001465, dated Oct. 9, 2015, 10 pages.

* cited by examiner

CAPACITIVELY SHIELDED HOUSING, IN PARTICULAR CAPACITIVELY SHIELDED COMPONENT HOUSING FOR AN ANTENNA DEVICE

STATEMENT REGARDING FEDERALLY SPONSORED RESEARCH OR DEVELOPMENT

None.

CROSS-REFERENCE TO RELATED APPLICATIONS

This application is the U.S. national phase of International Application No. PCT/EP2015/001465 filed Jul. 16, 2015; which claims priority to German Patent Application No. 10 2014 011 514.3 filed Jul. 31, 2014. The disclosures of these prior applications are incorporated herein in their entirety by reference.

FIELD

The invention relates to a capacitively shielded housing, in particular a capacitively shielded component housing for an antenna device such as a mobile communications antenna, according to the preamble of claim 1.

BACKGROUND AND SUMMARY

In accordance with current standards, in mobile communications technology for example, reflectors are used for mobile communications base station antennas, the rear side of which reflectors opposite the radiator side is formed in a manner similar to a housing. For example, cabling, phase shifters, adjustment devices for phase shifters, filter assemblies etc. can be accommodated in this space. In this case, the reflector can be provided with side-wall webs, which become fixing flanges which terminate parallel to the reflector plane and to which a reflector cover can then be screwed, for example.

In addition, for mobile communications antennas that meet the packing density of today, active assemblies such as a radio or a remote radio head (RRH) are often also accommodated on the rear side of the reflector. Radios of this kind can simultaneously also function as the housing cover by being correspondingly screwed onto the reflector.

It is therefore invariably necessary to fix the relevant parts to one another using a plurality of screws.

According to a known standard, for example, on the rear side of the reflector on said fixing flanges, a plurality of spaced-apart press nuts can accordingly be press-fitted into holes in the reflector fixing flange in order to create here a pre-fitting arrangement for the subsequent mounting. A cover in which holes are also made can then be placed on the fixing flange. These holes are aligned with the holes in said press nuts. Internal threads are formed in the press nuts themselves, such that suitable screws for fixing the cover can be screwed in from the opposite side.

In all these cases, however, it has been found that above all the press-fitting of said press nuts or the press-fitting of said press-fit bushes can cause very small inclined angles, with the result that there are no uniquely reproduced contact points between the reflector, the cover and/or the housing e.g. of an active component. Contact points that cannot be uniquely reproduced, however, invariably lead to altered conditions, which in particular in HF engineering can produce unwanted intermodulations.

The above-mentioned tolerance errors can arise not only in the vertical direction but also in the horizontal direction with respect to the components to be fastened to one another in a substantially planar manner. These tolerance errors are generally unacceptable or cannot be overcome.

Finally, when the individual assemblies are joined onto one another and screwed together, surface damage can also be caused to the electrically conductive coatings or to the metal, which damage likewise again results in modified contact conditions. In all these cases, the manufacturing process means that there is only very poor control of the contact pressure, again because of different surface areas (diameters of the contact portions).

Nevertheless, the rear reflector space comprising the assemblies and components accommodated therein need to be shielded by placing on an electrically conductive cover. In particular, it is essential to shield the radio from other vital antenna components.

Thus, by screwing together the corresponding shielding parts, shielding against high-frequency interfering radiation in particular is also intended to be achieved, such that no electromagnetic radiation can escape to the outside or, vice versa, no electromagnetic radiation can enter the shielded space from the outside. Shielding against high-frequency radiation is generally of great importance for all aspects of communications technology, including mobile communications.

As well as the infiltration of undesired signal components, undesired intermodulation products may also occur.

The most frequent cause of electromagnetic interfering radiation is the deficient design of the connection between housing walls and corresponding cover parts. Small gaps, which act like slot antennae, can greatly reduce the shielding attenuation. These gaps result from poor contacts, tolerances and/or from irregularities or unevenness between the housing walls or cover surfaces that are placed on one another at corresponding contact portions.

WO 2013/033894 A1 discloses an antenna arrangement that comprises an antenna/signal processing unit having a first groove arrangement, and an antenna portion having a second groove arrangement, which processing unit and antenna portion can be inserted into one another using a gasket body.

Furthermore, WO 2013/096880 A1 discloses that capacitive couplings can be provided between different modules, for example between a main module and a sub-module.

In contrast, the object of the present invention is that of providing a capacitively shielded housing, in particular a capacitively shielded component housing, for an antenna device, for example a mobile communications antenna.

The problem is solved according to the invention in accordance with the features specified in claim 1. Advantageous configurations of the invention are described in the dependent claims.

If, for example, corresponding antenna components such as cables, phase shifters, adjustment devices and filter assemblies, etc. are accommodated on a housing or reflector housing, on the side of an antenna arrangement or mobile communications antenna device that is to the rear with respect to the radiators, and this housing space is shielded from a radio or remote radio head to be placed thereon, or in general shielded from other HF electronics, by placing on a shielding plate, within the context of the invention it is then possible to avoid having to rigidly mount said shielding plate on the corresponding reflector housing using a plurality of screws as is otherwise conventional.

In addition, within the context of the invention, undefined contact points and contact conditions, such as occur or can occur in particular in a fixing method using a plurality of screws, are avoided.

According to the invention, for this purpose it is provided, in principle, that the housing space to be shielded should comprise housing contact regions or housing flanges, on which corresponding contact regions or flanges of the shielding plate rest.

In this case it is provided, according to the invention, that the housing or housing parts that are each conductive or are coated with an electrically conductive surface, on the one hand, and the shielding plate on the other hand, are not galvanically interconnected in the contact region thereof, but rather are galvanically isolated from one another with the interposition of an insulation layer or insulation film, with the result that a capacitive coupling between the housing, i.e. in particular the reflector component housing, and the shielding plate or shielding cover is produced in this case in the application or contact region of the corresponding application and/or contact portions. Capacitive shielding of this kind has significant advantages compared with galvanic contacting of the corresponding components e.g. by means of the above-mentioned use of screws. The invention prevents undefined contacting conditions and thus above all counteracts the risk of intermodulations.

According to the invention, the corresponding contact surfaces are not perpendicular to the mounting direction, and are therefore in general not perpendicular to the orientation of the opening plane of the housing or reflector housing but instead extend in parallel therewith. In other words, the corresponding capacitively coupled application and/or contact regions or flange regions between the reflector housing on the one hand and a shielding covering and/or a shielding plate on the other hand are oriented parallel to the mounting direction and thus parallel to the central axis and/or mounting direction.

This results in the further advantage, which can be achieved within the context of the invention, that the corresponding application portions or contact portions, on which the capacitive coupling between the reflector housing and the shielding plate is formed, do not result in an increase in the required installation space in the attachment direction, but rather that the parts can be inserted into one another in the mounting direction and therefore it is not necessary to increase the installation space in the mounting direction in order to implement the invention.

However, it is also possible, within the context of the invention, that the corresponding capacitively coupled application or contact portions between the reflector housing and the shielding plate are not necessarily oriented parallel to the mounting direction, and thus necessarily parallel to a central axis extending through the reflector housing, but rather extend, for example, obliquely towards the mounting direction or the central axis and are designed and/or adjusted accordingly. The contact surfaces that bring about the capacitive coupling therefore do not necessarily have to be oriented at an angle of 0° relative to a surface extending perpendicularly to the mounting direction of the central axis (and thus parallel to the central axis or mounting direction), but can instead extend at an angle of between $0° \leq \alpha < 90°$. If the angle were $\alpha = 90°$, the two contact surfaces would extend perpendicularly to the mounting direction or to the central axis, i.e. would come to rest on one another, as a result of which the height of the overall structure would increase, which is to be avoided according to the invention.

The angle $\alpha$ can preferably assume values that deviate from 90° as significantly as possible, in order to permit the contact surfaces to at least extend obliquely towards the mounting direction or the central axis.

Finally, within the context of an advantageous embodiment, it is also provided for corresponding electrically non-conductive (dielectric) retaining elements to be provided at the corresponding mounting points, preferably on at least one of the two capacitive application portions that are to be brought into contact. According to the invention, for this purpose corresponding retaining nipples can be clamped (preferably without the use of tools) in corresponding holes, for example in the reflector housing, at a distance from the mounting plate to be mounted, onto which nipples the contact surfaces to be shielded, for example of the shielding plate, can then be pushed in order to be retained in a predefined non-positively loaded contact position that is as parallel as possible, relative to the corresponding contact portion of the reflector housing, while forming the capacitive coupling.

Finally, a further force-loading and/or orientation device is preferably formed, preferably on the shielding plate, which device makes it possible for the contact surfaces provided on the shielding plate for the capacitive coupling not to come to rest at an angle to the corresponding contact surface, for example of a housing and in particular of a reflector housing, but in fact rather to come to rest so as to be oriented in a manner as parallel as possible, i.e. exactly parallel. This can be ensured by means of an appropriately pre-impressed deformation on the shielding plate. This can be achieved, for example, by the actual shielding plate portion transitioning via an impression that has, for example, an S-shaped cross section, into the adjacent preferably plane-parallel contact portion (that comes to rest parallel to the contact surface of the component and/or reflector housing in order to produce a capacitive coupling). This S-shaped pre-impression or equivalent measures make it possible for the contact surface of the shielding plate to adapt to the corresponding orientation and position of the contact surface of the component and/or reflector housing. In this case, the S-shaped deformation can, in some circumstances, even produce some force-loading towards the contact surface of the component and/or reflector housing if the overall width of the shielding plate together with the contact surfaces is at least slightly wider than the opening width of the component and/or reflector housing. Moreover, this design makes it possible for the contact surfaces of the shielding covering or of the shielding plate to accordingly orient themselves in an optimal manner relative to the contact surfaces of the component and/or reflector housing.

In addition and alternatively, a corresponding shielding plate can also be divided in two, for example, the two shielding plate portions or halves overlapping at least in part, and forming a capacitive coupling. This makes it possible, for example, to adjust the width of the shielding plate to the housing opening to be shielded, thus ensuring that the contact portions can precisely occupy the exact position in which they bring about the capacitive coupling while forming a uniform spacing by interposing a dielectric layer.

BRIEF DESCRIPTION OF THE DRAWINGS

Further advantages, details and features of the invention will emerge from the embodiments illustrated in the drawings, in which, in detail.

DETAILED DESCRIPTION OF NON-LIMITING EMBODIMENTS

Figure 1:
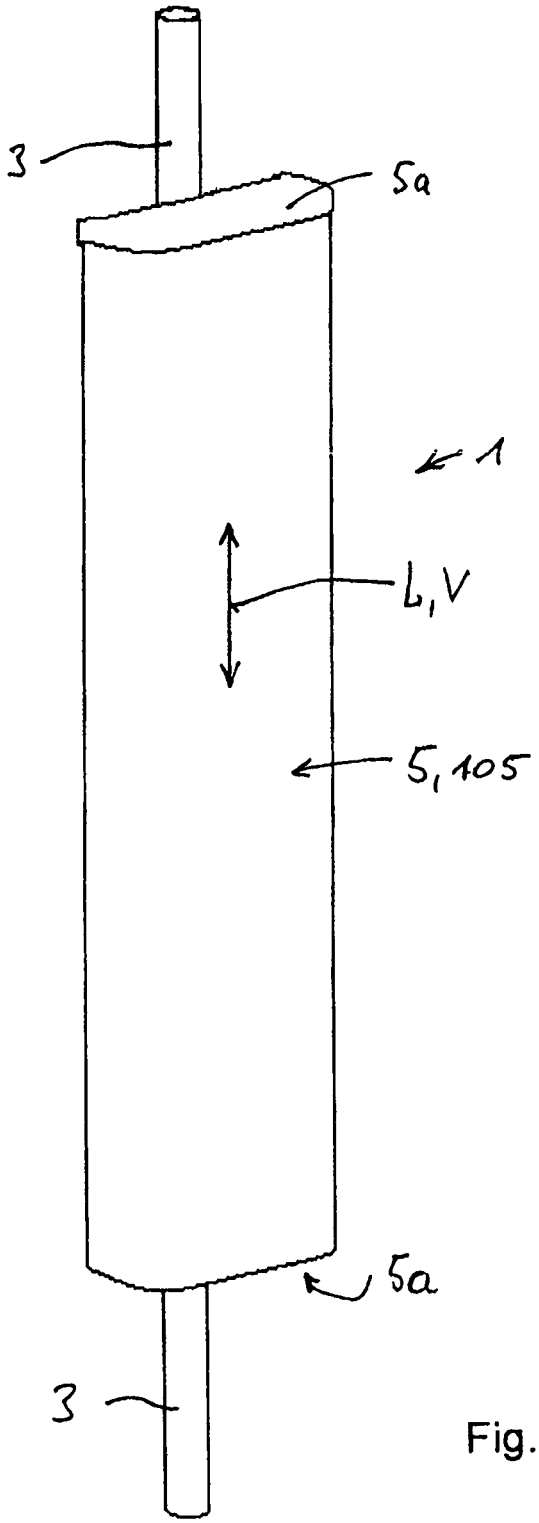
FIG. 1: is a schematic view of an antenna, in particular a mobile communications antenna.

FIG. 1 schematically shows an embodiment of an antenna or of a mobile communications antenna 1, as it can be fixed to a mast 3 or another suitable point for example.

An antenna or mobile communications antenna of this kind usually comprises a housing or a covering 5 having a radome 105 and an upper and lower cover cap 5*a*. The connections provided for the operation of the antenna, including the coaxial connections and the control connections, can in particular be formed at the lower cover cap 5*a*, but there is no restriction to this.

An antenna or mobile communications antenna 1 of this kind is usually mounted so as to be positioned vertically or substantially vertically.

Mobile communications antennas of this kind can also be designed as what are known as active antennas. In this case, the active mobile communications antennas comprise high-frequency electronics that are preferably integrated into the antenna housing on the rear side or placed on the rear of the antenna housing, in the form of a radio or a remote radio head. The antenna housing then forms a common overall housing together with the radio or remote radio head.

Figure 2A:
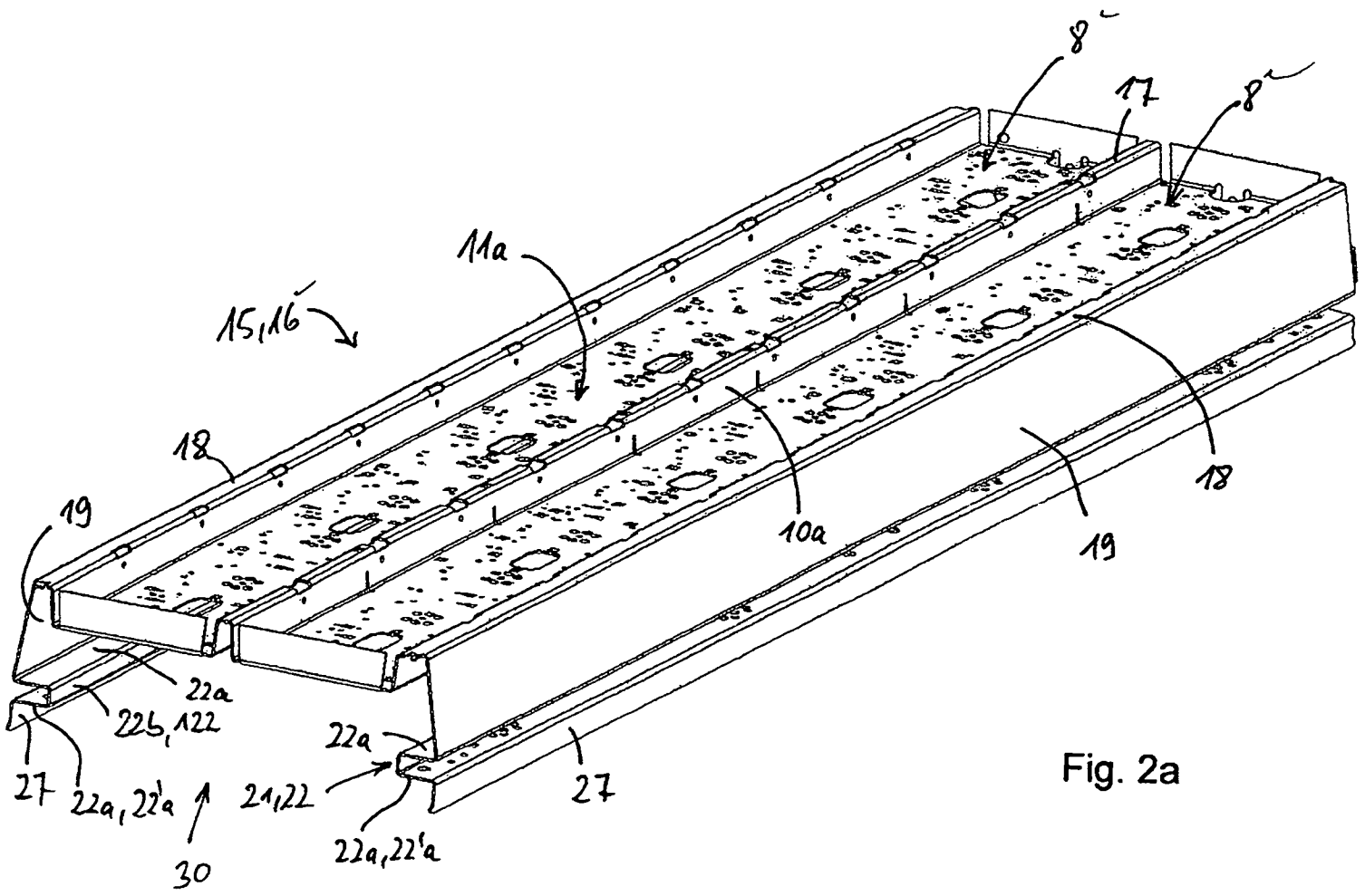
FIG. 2*a*: is a three-dimensional view of a component or reflector housing when the shielding covering or shielding cover has been removed, an antenna covering, or radome, being omitted.
Figure 2B:
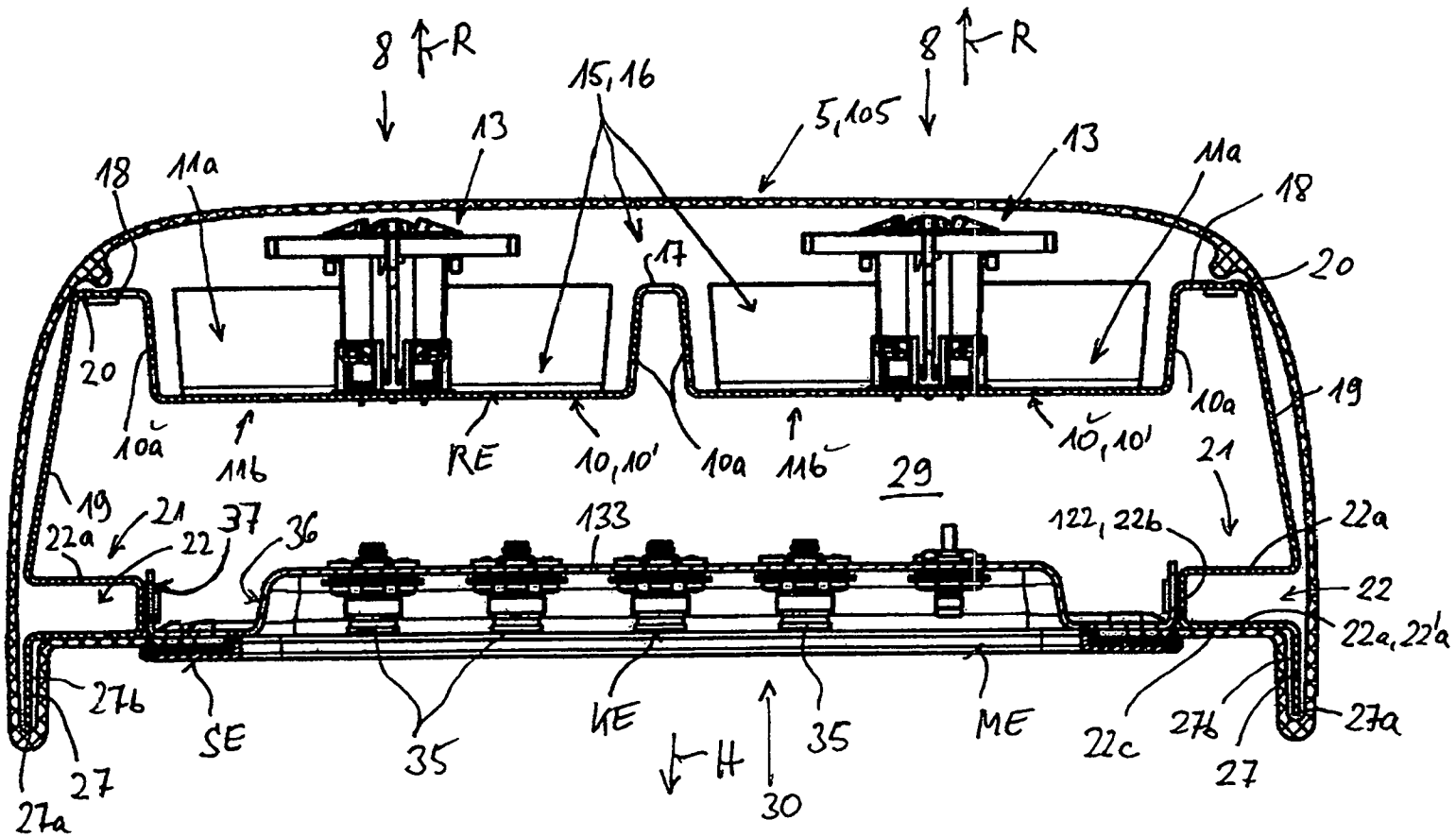
FIG. 2*b*: is a cross section through the embodiment according to FIGS. 1 and 2 in the region of a power strip.
Figure 2C:
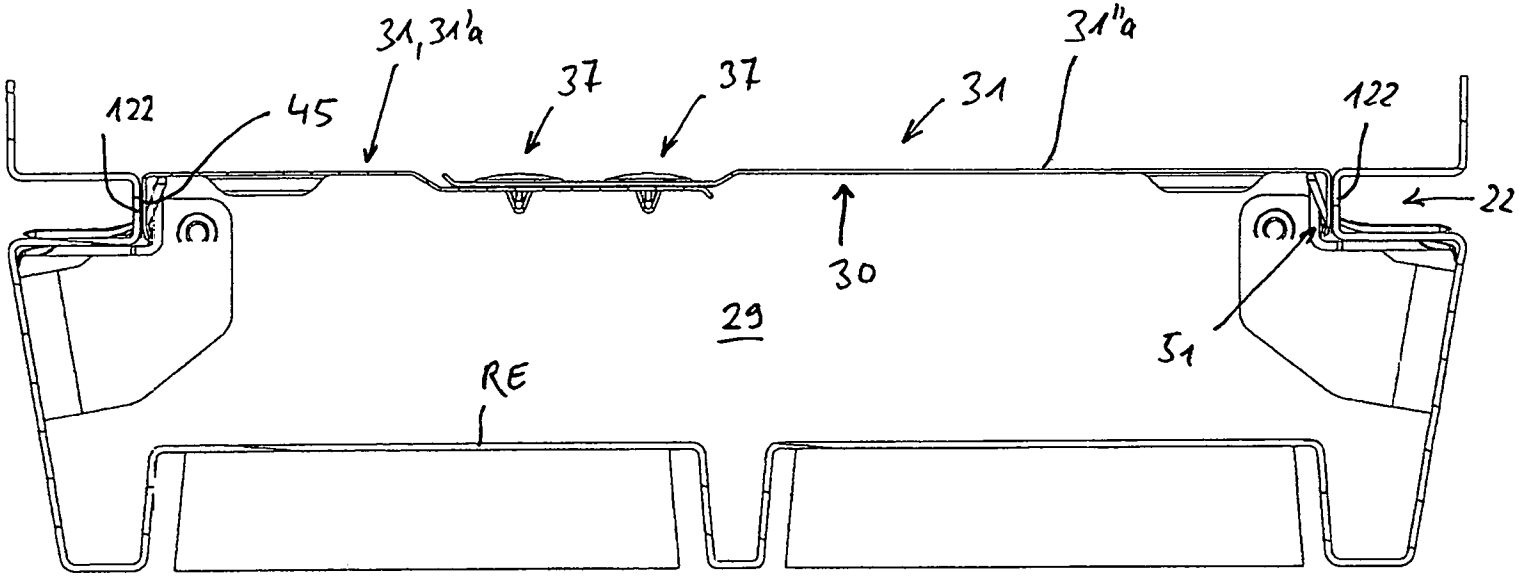
FIG. 2*c*: is a simplified cross-sectional view similar to FIG. 2*a*, but at a portion of the mobile communications antenna that is offset relative to the power strip.

FIG. 2*a* is a three-dimensional view of an overall reflector 15, and FIG. 2*b* and FIG. 2*c* are horizontal cross sections through the mobile communications antenna 1 shown in FIG. 1. In a view according to FIG. 2*b*, the electrical HF components that are usually additionally provided on the rear side of the overall reflector 15 are not shown.

It can be seen from these drawings that the embodiment shown is an antenna, i.e. a mobile communications antenna, having two antenna gaps 8 that extend in parallel with one another, i.e. that are usually oriented vertically or substantially vertically.

Each antenna gap 8 comprises a reflector 10 having a reflector front side 11*a* and a reflector rear side 11*b*, in front of which reflector a plurality of radiators or radiator groups 13 are generally arranged, in a known manner, so as to be spaced apart from one another. These can be plane-polarised or dual-polarised radiators, etc. that radiate, for example, in two polarisation planes that are perpendicular to one another and that are preferably oriented at an angle of +45° to the vertical or to the horizontal. In this respect, reference is made to known solutions in which corresponding dipole radiators or for example what are known as vector radiators or, for example, also patch radiators, etc. can be used, which radiators are part of a mono-band, dual-band or multi-band antenna arrangement.

In the embodiment shown, the two reflectors 10 that each belong to one antenna gap 8, respectively, do not form single reflectors having an antenna gap therebetween, but instead are part of a common overall reflector arrangement 15 that is formed in one piece, is integral in the embodiment shown, and is also referred to for short in the following as the component and/or reflector housing 16. In this case, the drawings further show that the reflector 10 provided for an antenna gap 8, i.e. in the embodiment shown the gap reflector or partial reflector 10' provided for an antenna gap 8, is provided with a side web 10*a* on the two sides thereof that each extend in the longitudinal direction L, i.e. usually in the vertical direction V, which side web is oriented, on the reflector front side 11*a*, for example perpendicularly to or, at an angle that differs therefrom, obliquely to the reflector plane RE. Usually, the side webs 10*a* that are each provided laterally relative to an antenna gap 8 are oriented so as to be slightly divergent in the direction of radiation R with respect to the radiator or radiator group 13 provided therebetween.

In this case, the respectively adjacent side webs 10*a* of the two adjacent antenna gaps 8 are rigidly interconnected by means of a connecting web 17, i.e. a connecting bridge 17. In other words, the two gap reflectors or partial reflectors 10' of the two antenna gaps 8 form a common rigid, integral reflector structure.

The two side webs 10*a* that are on the outside and are the most remote in each case also transition, on the radiation side of the reflector arrangement, into a connecting web 18 that extends in an outwardly diverging manner, which connecting web then transitions, via a further elbow 20, into a first shielding wall 19 that extends more or less counter to the radiation direction R of the antenna arrangement.

In this case, the shielding walls 19 mentioned extend in a slightly diverging manner in the rear direction H, but this is not necessary in principle.

An anchoring portion 21 adjoins the shielding walls 19. That is to say that the two outside shielding walls 19 that extend in the rear direction H transition into an anchoring portion 21, specifically via a in the manner of a horizontal U-shaped mounting portion 22, the opening region of which faces outwards in each case, which mounting portion ultimately consists of two side webs 22*a* that are more or less parallel in the embodiment shown and that are interconnected in the radiation direction or front direction R, preferably so as to be spaced apart from one another in parallel and by means of a base web 22*b* that extends transversely or perpendicularly to the reflector plane RE, the above-mentioned base webs 22*b* forming the contact or anchoring housing portions 122 that will be explained in detail in the following and on which a shielding covering is to be positioned.

In this case, the side web 22'*a* that is remote from the antenna gaps 8 comes to rest in a mounting plane ME in which or close to which the electrical HF components, which will be explained subsequently, are mounted.

Finally, the above-mentioned side web 22'*a* that is more remote from the antenna gaps 8 transitions into a second shielding wall 27 which is preferably positioned quasi in the extension of the first shielding wall 19 and is separated therefrom only by the mentioned anchoring portions 21 formed in the manner of a horizontal U (the anchoring portion 21 ultimately also functioning as and being able to be interpreted as a shielding wall, either as an intermediate shielding wall or as a shielding wall that can be included in the first or second shielding wall). Said second shielding wall 27 is also an integral part of the overall reflector arrangement 15, i.e. of the overall reflector 16.

As a result, a receiving space 29 for a plurality of components to be shielded, including the cabling, is provided on the rear side of the component and/or reflector housing 16, the rear opening region 30 of which space is intended to be closed in a HF-tight manner and to be shielded by means of a shielding covering 31, i.e. in particular a shielding wall 31 or a shielding plate 31.

A simplified view that is comparable to the cross-sectional view according to FIG. 2*b* is again shown in FIG. 2*c*, but this time in a cross section that is not at the level of the power strip 133 that is to be explained in the following and is provided on the rear side of the antenna housing, but rather offset therefrom, showing a cross section through the shielding plate 31 that is also to be explained in the following. In this case, the view in FIG. 2*c* is shown rotated by 180° with respect to the view in FIG. 2*b*.

Figure 3:
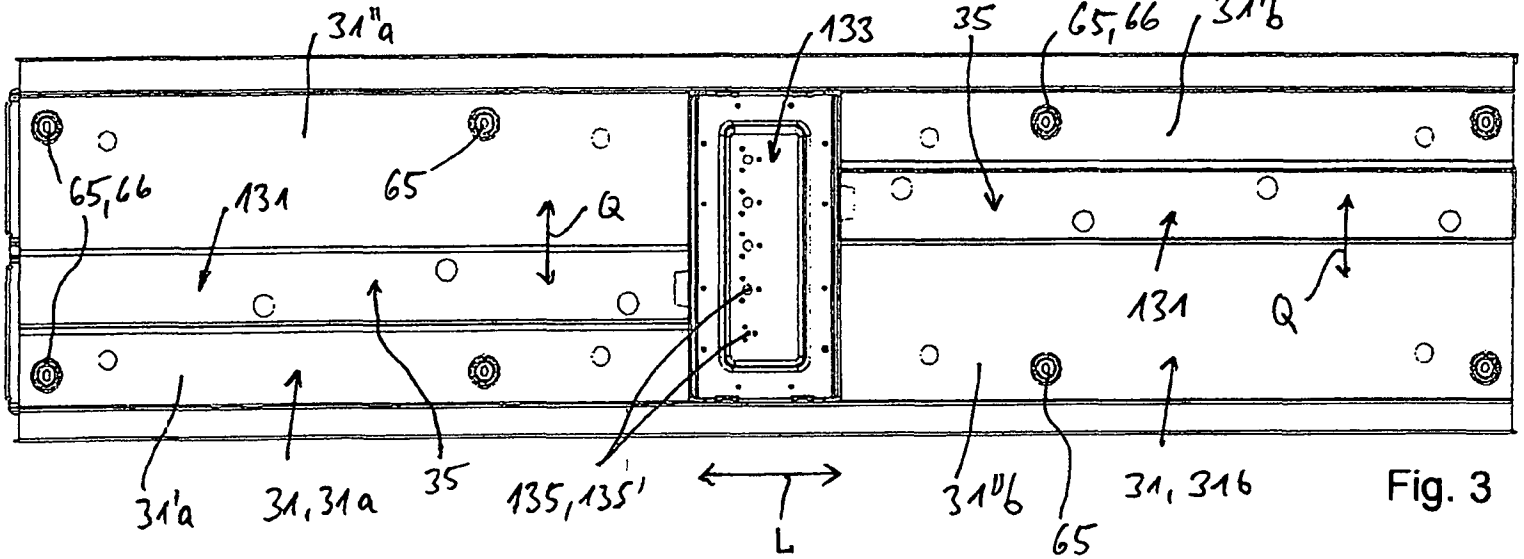
FIG. 3: is a rear plan view of the mobile communications antenna shown in the preceding drawings.

FIG. 3 is a rear view of the antenna or mobile communications antenna 1 shown in FIGS. 1 to 2*b*, specifically when the shielding covering 31 or shielding plate 31 has been placed thereon.

It can be seen therefrom that, in the specific embodiment, although this may be different in other variants, it is not the case that a continuous shielding plate 31 is provided over the entire length of the antenna 1, but rather two shielding plate arrangements 31*a*, 31*b* are provided that are offset from one another in the longitudinal direction L of the antenna. This is because, in the embodiment shown, a power strip 133 (which can also be seen in cross section in FIG. 2*b*) is provided in the central region of the antenna, which power strip is provided with a plurality of interfaces 135, in particular coaxial interfaces 135, for example in the form of plug-in connectors 135'. Corresponding connection cables, coaxial cables, etc. can be connected here, which cables lead to the electrical components inside the antenna and thus ultimately to the radiators. In the embodiment shown, the active high-frequency electronics (also referred to as a radio, radio unit or remote radio head) to be mounted on the reflector are connected to this power strip.

Figure 4:
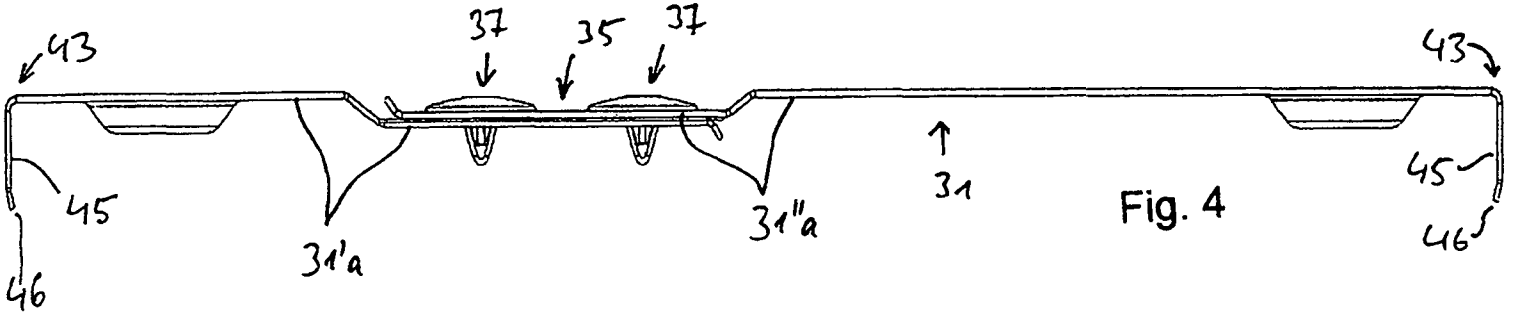
FIG. 4: is a partial cross section through the rear shielding covering or of the shielding plate.

In the embodiment shown, each of the shielding covering or plate arrangements 31*a*, 31*b* visible in the rear view according to FIG. 3 is not itself a single piece, but instead is preferably formed in two parts, as can also be seen in the cross section according to FIG. 4. This means that the two shielding wall halves or portions 31'*a*, 31"*a* and 31'*b*, 31"*b* provided in FIG. 3 and in FIG. 4 can be pushed further apart or further together in the transverse direction Q transversely to the longitudinal direction L, according to the double-headed arrow shown in FIG. 4.

Figure 5:
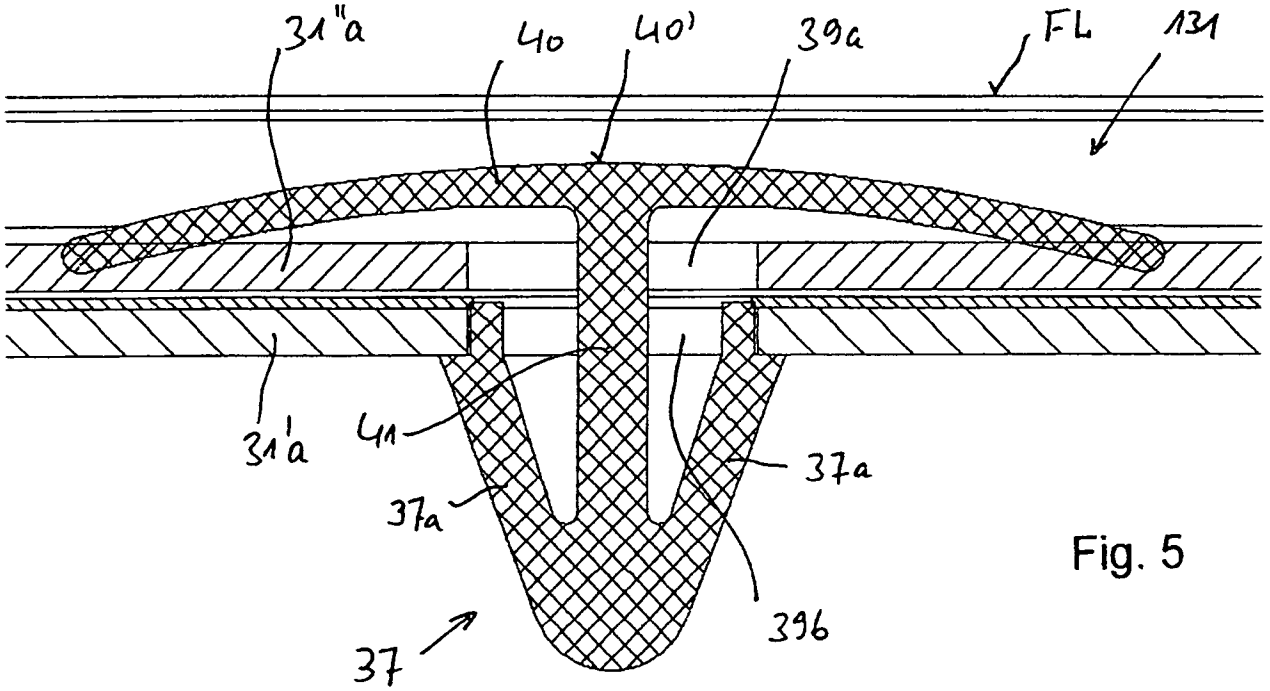
FIG. 5: is an enlarged partial cross section through a corresponding portion of a shielding covering or of a shielding plate, illustrating that the shielding covering or the shielding plate consists of at least two parts that can be adjusted relative to one another in the transverse direction and that are displaceably held together by means of retaining clips or retaining elements.

For this purpose, the two shielding wall portions 31'*a* and 31"*a*, and 31'*b*, 31"*b*, respectively, each have an overlapping shielding wall contact region 35, which regions are plane-parallel to one another, specifically with the interposition of an insulation layer 36, for example in the form of a film or a plastics film, that separates the two shielding wall portions. This also ensures capacitive contacting between the two shielding wall portions (FIG. 5).

The overlapping region 35 of the shielding wall portions 31'*a* and 31"*a*, and 31'*b* and 31"*b*, respectively, is formed in a portion 131 that is recessed towards the plane of the reflectors 10, it being possible for connecting or retaining clips 37 or comparable retaining devices 37 to be inserted in this region in each case, the retaining portion of which retaining devices is pushed, by means of two spread retaining feet 37*a*, through corresponding holes 39*a*, 39*b* in the relevant portion of the shielding wall portions and is held on the edge of the holes so as to be partially inserted therein. In this case, the holes 39*a*, 39*b* come to rest in a position in which they at least partially overlap. Said holes can also be formed as slots that preferably extend in the transverse direction Q. This recessed design of the overlapping portions of the two shielding plate regions also ensures that the upper side 40' of the connecting or retaining clips 37, which will be explained in detail in the following, does not protrude beyond the upper side FL of the other portions of the shielding plates 31. A bracket or head region 40 or the like that covers the two at least partially overlapping holes 39*a*, 39*b* is provided in a manner similar to an anchor opposite the mentioned retaining feet 37*a*, the comparatively narrow anchor portion 41 of which head region penetrates the corresponding holes 39 in the two contact plate portions, which holes are in principle arranged substantially congruently above one another, and holds the two parts so as to be prestressed towards one another. Since the anchor portion 41 has a significantly smaller diameter than the hole 39 through which it passes, the two shielding wall portions 31'*a* and 31'*b*, and 31"*a* and 31"*b*, respectively, can in each case be displaced relative to one another by a corresponding amount in the mentioned transverse direction Q, i.e. the shielding region can be adjusted so as to be wider overall or so as to be narrower by a specified amount.

Figure 6:
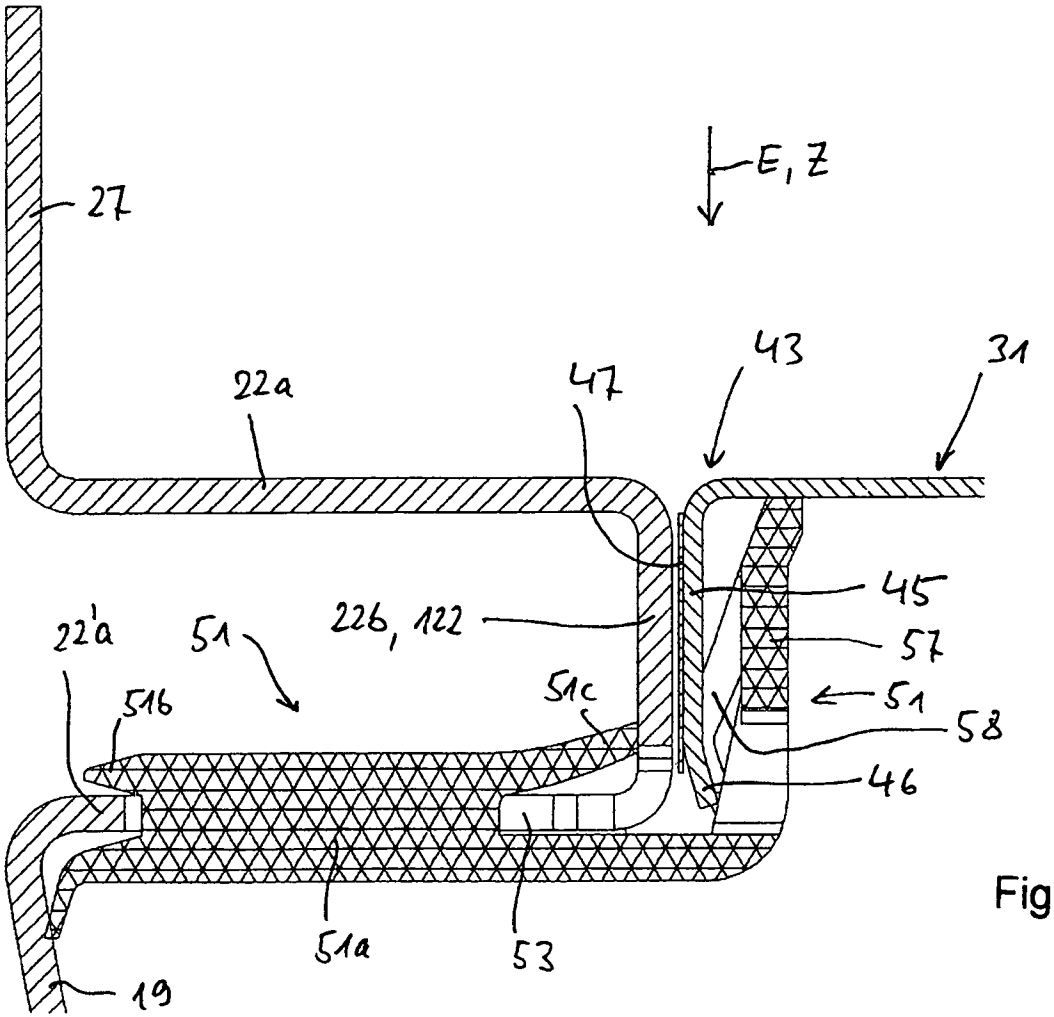
FIG. 6: is an enlarged cross-sectional view to illustrate the contact situation between corresponding contact or anchoring portions between the contact housing and/or reflector housing on the one hand and the shielding covering or shielding plate on the other hand.

Moreover, as can be seen in the cross section according to FIGS. 4 and 6, the shielding plate comprises corresponding shielding plate contact portions 45 on the respective longitudinal edges 43 thereof, which contact portions, with the exception of an insertion limb 46 that precedes said portions in the insertion direction, i.e. precedes the free end of the shielding plate contact portions 45, extend in parallel with the adjacent contact or anchoring portion 122, 22*b* on the housing wall, specifically on the component and/or reflector housing 16, and are thus formed in parallel with the mentioned contact or anchoring housing portion 122, 22*b*. The mentioned contact portions 45 will also be referred to in the following as contact or anchoring cover portions 45.

At least one of the corresponding contact or application surfaces is covered or pasted over with an insulation layer or film 47, or an insulation film 47 of this kind is at least interposed, with the result that a capacitive coupling is produced and galvanic contact is prevented here between the shielding plate on one side and the reflector or the reflector housing on the other side.

In order to ensure anchorage here, the anchoring portions 51*a* of retaining elements 51 (made of non-conductive material such as, in particular, plastics material) that are arranged so as to be spaced apart from one another in the longitudinal direction L are inserted, preferably without the use of tools, through corresponding holes 53, as can be seen in the enlarged cross section according to FIG. 6. The corresponding retaining portion 51*a* comprises corresponding projections 51*b* and 51*c* such that the retaining portion 51*a* can be obliquely pushed through the corresponding holes 53 in the reflector housing portions in an inclined manner and can then be pushed in such that the opposing projections 51*b* and 51*c* engage behind the corresponding hole 53.

These retaining elements 51 form an L-shaped web 57 that protrudes towards the shielding wall 31, engages below the contact or anchoring portion 45 and comprises a clamping arm or a clip 58 that faces the contact surfaces. This makes it possible for the corresponding contact or application portion of the shielding plate to be inserted from above in the mounting or insertion direction E according to the arrow in FIG. 6, in parallel with the contact or anchoring housing portion 122 on the reflector housing 16, specifically slightly counter to the force of the clamping arm 58 that is held in a prestressed manner. Said clamping arm 58 then presses the corresponding contact or anchoring cover portion 45 of the shielding covering of the shielding plate 31 into a completely parallel position on the corresponding contact or anchoring housing portion 122, 22*b* on the component or reflector housing 16, FIG. 6 also showing the insulating intermediate layer 47 in order to produce the capacitive coupling here.

This ensures high-frequency-tight shielding of the housing interior 29. The relative adjustment in the transverse direction according to the arrow Q means that the shielding plate can be exactly adjusted to the desired transverse extension dimensions between the corresponding contact surfaces on the reflector housing and can compensate for tolerance errors.

Figure 7:
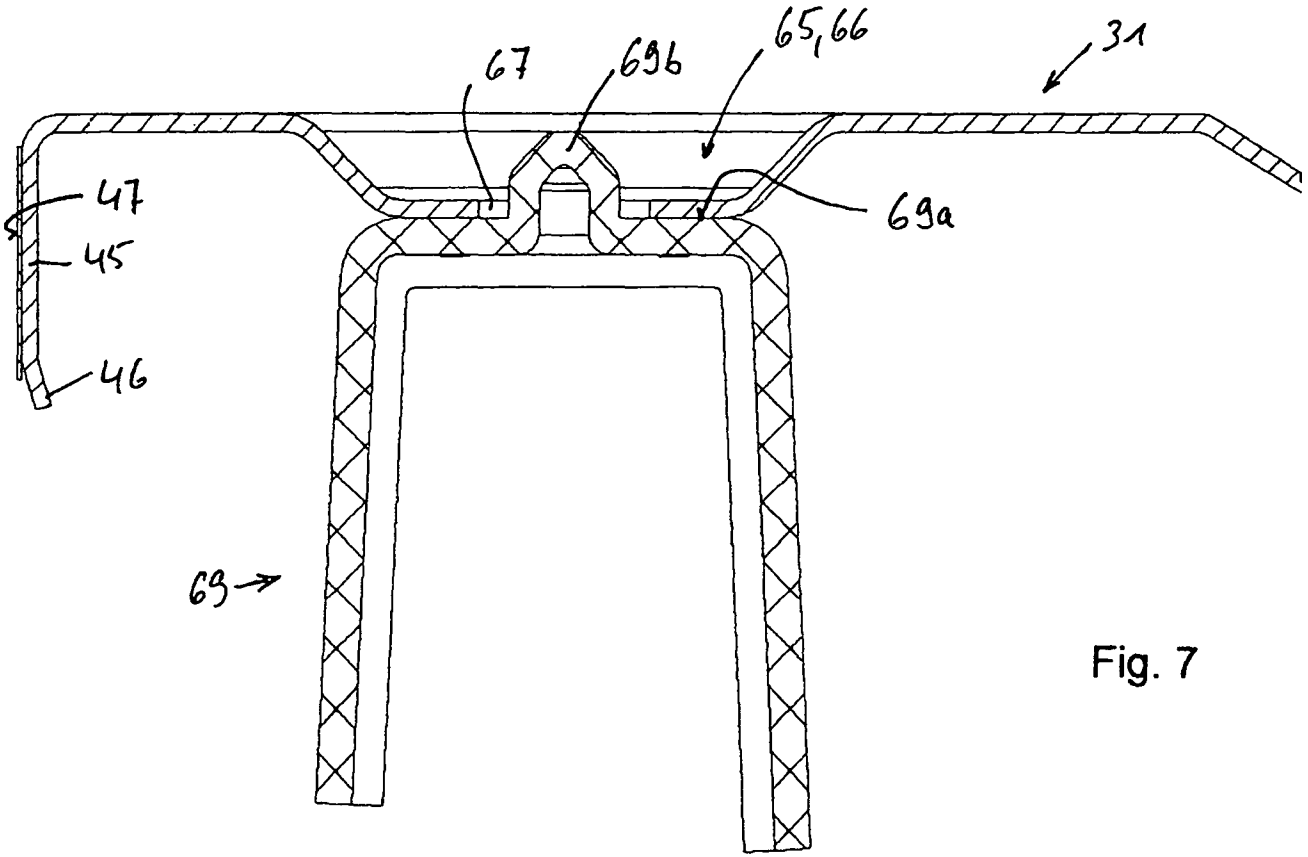
FIG. 7: is an enlarged cross-sectional view of a retaining element for additional fixing of the shielding covering or the shielding plate.

The plan view according to FIG. 3 also shows that cup-shaped recesses 66 (in plan view) are formed at various support points 65, which recesses are shown in the enlarged cross section according to FIG. 7. Holes 67 are made in the centre of these recesses 66. In this region, supporting and retaining elements 69, preferably made of plastics material, are fixed (e.g. rigidly screwed or rigidly clipped) to the rear side of the reflector surface, i.e. on the actual reflector portions, said supporting and retaining elements 69 being shown in cross section in FIG. 7. Said supporting and retaining elements 69 comprise a central pin or projection 69*b* formed on the top, on the upper or end face 69*a* of said supporting and retaining elements, which projection penetrates the corresponding hole 67 in the corresponding shielding wall. This ensures that the corresponding shielding plates 31 cannot be displaced in the longitudinal direction L, since the pin secures the shielding plate in this respect. Displacement in the transverse direction Q is prevented by the shielding plate contact portions 45 which come to rest in contact, in a parallel manner, with the corresponding contact portions 122 of the reflector plate or reflector body, i.e. in general in contact in a parallel manner with the corresponding contact or anchoring housing portions 122 on the component or reflector housing 16, and are fixed in this position by means of corresponding retaining devices or retaining clips. This provides slip-resistant anchorage of the shielding surface, which surface is preferably divided in two and is adjustable in the transverse direction, without additional accessories and fixing means. As can be seen in FIG. 7, in the case the hole 67 has a diameter that is of such a size in comparison with the outer diameter of the pin or projection 69*b* that, while adjusting to the actual opening width of the opening region 30, the two parts or halves of the shielding plate can also be displaced slightly in the transverse direction in order to compensate for tolerance errors. In this respect, the opening 67 can also be formed as a slot in the transverse direction Q, such that displacement of the shielding plate in the longitudinal direction L is simultaneously prevented.

Figure 8:
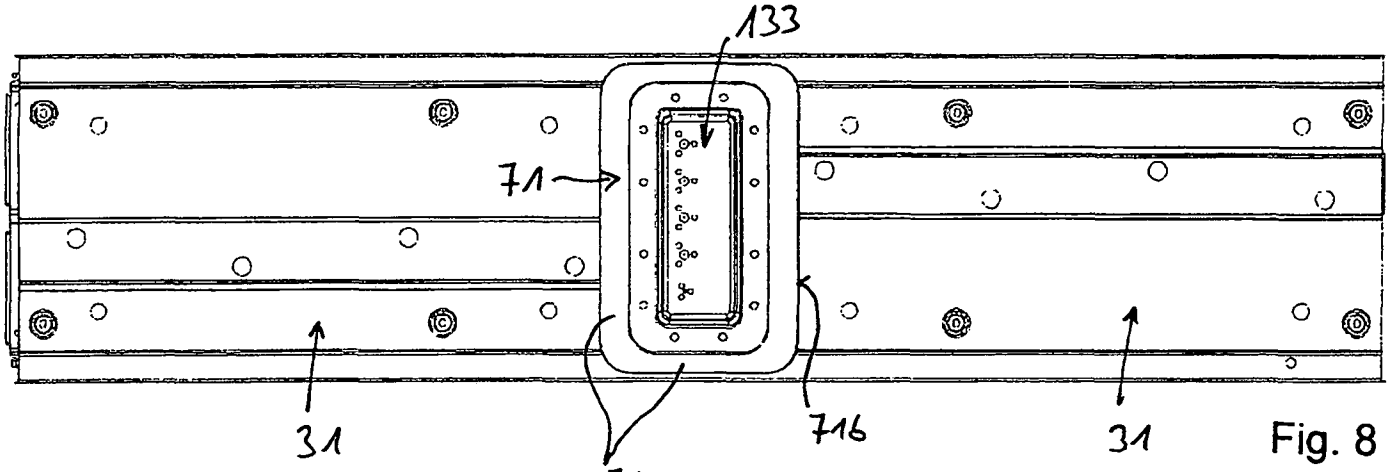
FIG. 8: is a rear view of the described mobile communications antenna, similar to FIG. 3, comprising a shielding frame that has been placed on in the region of the power strip.
Figure 9:
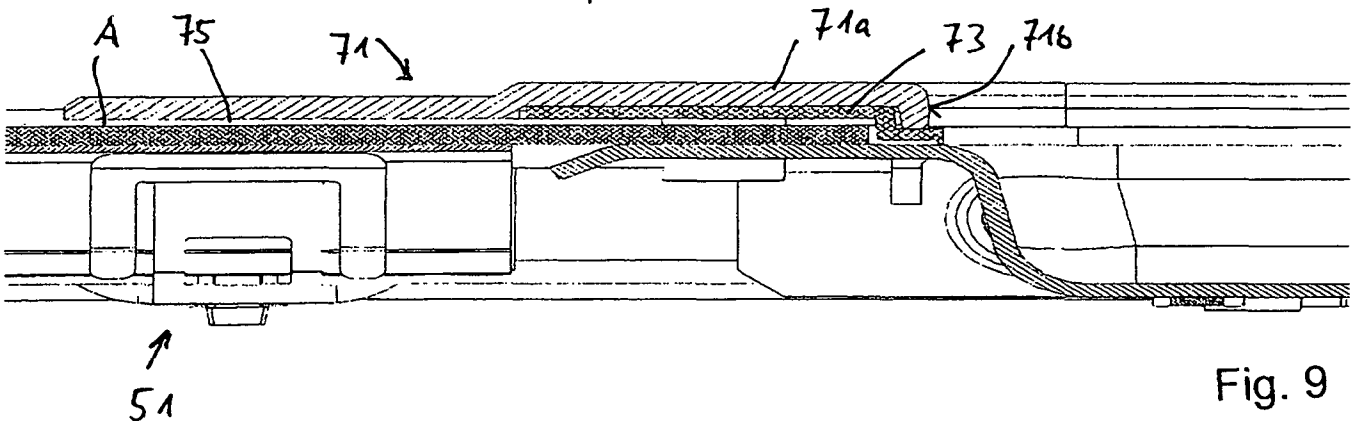
FIG. 9: is a partial cross section through the shielding frame in FIG. 8, illustrating the capacitive mounting of the shielding frame.

Finally, following appropriate mounting of the two shielding plates that are positioned so as to be offset from one another in the longitudinal direction L, the intermediate region shown in plan view in FIG. 3 and FIG. 8 and in cross section in FIG. 9 still remains, in which region the mentioned power strip 133 having the plurality of connections 135, 135' is positioned.

Finally, a shielding frame 71 is placed thereon, the peripheral flange 71*a* of which frame is wide enough to still be able to shield the reflector housing interior 29 from the outside so as to be high-frequency-tight despite the existing capacitive coupling with the end portion of the relevant shielding plate located therebelow. Here, too, an insulating spacer 73 is attached or provided peripherally on the underside of the shielding frame 71 in order to ensure the capacitive coupling between the shielding frame 61 and the ends of the shielding walls that extend in parallel therewith. In this case, an air gap 75 is formed between the free edge 71*b* of the peripheral flange 71*a* closer to the material portion of the congruent shielding plate 31 located therebelow in order to produce a capacitive coupling here too, while preventing galvanic contact. In this case, the width or length of the peripheral flange 71*a* is kept sufficiently small relative to the spacing A between the peripheral flange 71*a* of the shielding frame 71 and the shielding plate 31 located therebelow that high-frequency radiation can neither enter the interior 29 nor escape therefrom to the outside.

Figure 10:
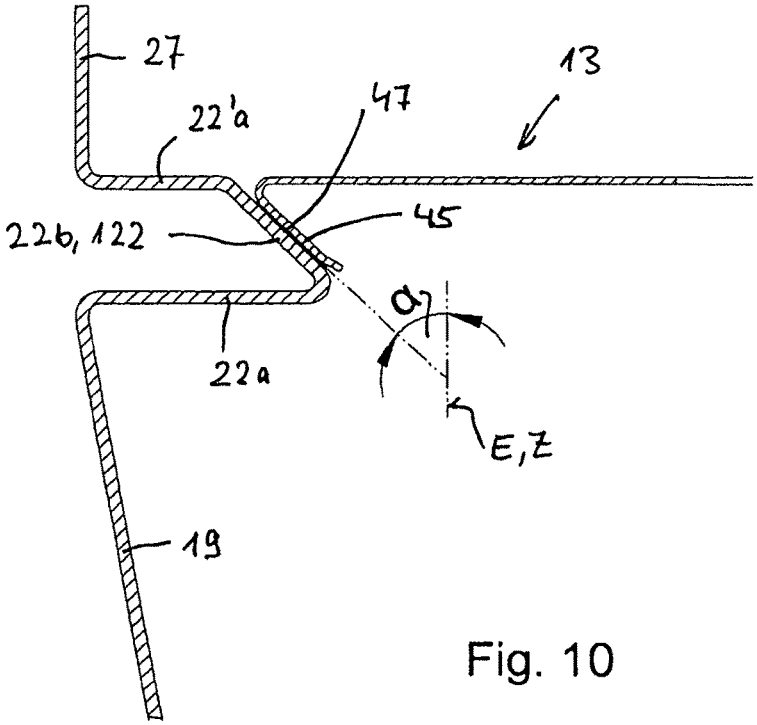
FIG. 10: is a cross-sectional view of an embodiment that differs from FIG. 6.

The following FIG. 10 shows, merely in a schematic partial cross section, that, deviating from the preceding embodiments, the orientation of the capacitively coupled contact portions on the reflector housing on the one hand and on the shielding plate on the other hand in principle need not necessarily extend parallel to the mounting direction E, i.e. parallel to the insertion direction E or to the central axis Z that penetrates the overall housing arrangement, but instead the angle $\alpha$ between the application surfaces of the contact surfaces on the one hand and the mounting direction E or the central axis Z on the other hand need not necessarily be 0° (i.e. parallel to the direction E or Z), but instead can assume any desired value of less than 90°.

In this case, the angle $\alpha$ should be intentionally smaller than 90° in order that the two contact portions that produce the capacitive coupling between the shielding plate and the reflector housing do not build on one another in the mounting direction E or in the direction of the central axis Z and contribute to increasing the height of the overall mounting space.

In this case, an embodiment according to FIG. 10 has the advantage that an almost trapezoidal design means that the shielding plate to be placed on top can be self-centring.

In the above-mentioned embodiment, in this case the shielding covering below the shielding plate 31 is automatically held in the position thereof in which the corresponding contact portions come to rest directly on top of one another in a parallel position, with the interposition of the insulation film 47. Furthermore, snap-in or locking elements formed in any desired manner, for example consisting of plastics material, may also be used to hold the shielding covering 31 or the shielding plate 31 in the desired self-adjusting position. In this case, FIG. 10 only shows a cross section along an edge side of the shielding plate 31. The configuration on the opposing longitudinal side would usually be symmetrical to a plane of symmetry extending in a longitudinal direction L and oriented perpendicularly to the plane of the drawing in FIGS. 3, 8 or 10. Since the shielding arrangement 31 is preferably rectangular, the corresponding contact surfaces formed on the component and/or reflector housing 16 on the one hand and on the shielding covering 31 on the other hand extend in parallel with one another.

The embodiments illustrated thus show that, within the context of the invention, capacitively coupled shielding of HF waves is possible using a shielding plate that is formed in one piece or in a plurality of pieces and is fixed to the antenna reflector at a suitable point. A dielectric in the form of an insulating solid body (or in the form of air) preferably functions as electrical insulation between the actual reflector or what is referred to as the overall reflector 15, and the shielding plate 31. The resultant gap between the interface and the shielding plate can be formed such that these two parts are insulated. It is further possible, in the region of the interface and of the described plug-in connector (in the central region on the rear side of the antenna in the embodiment shown, although it also being possible for this region to be provided at any other point on the antenna), for the corresponding frame to be formed, by means of overlapping with the reflector and the shielding plate, such that sufficient and optimal HF-shielding is achieved in any case.

In this case, within the context of the invention it is possible to achieve the advantage that the described shielding on the reflector can mounted or dismantled without the use of tools and in a manner that requires a minimal amount of space. In the insulated structure described, a uniform spacing and a more or less uniform contact pressure between the reflector and the corresponding shielding installation parts is guaranteed, for which purpose the described connecting or retaining clips 37 are used. This measure reduces the risk of undesired intermodulations. Moreover, the interfering radiation of the optionally passive antenna is prevented from penetrating active high-frequency electronics (radio, etc.) that is placed on behind. In addition, the front-to-back ratio improves when operating a corresponding antenna. Finally, the design of the overall arrangement according to the invention makes it possible to significantly shorten the assembly time and reduce costs.

The embodiment has been described for the cases in which the shielding covering or the shielding plate 31 is formed in a substantially plate-like manner. However, the shielding covering or the shielding plate 31 can also be formed as part of a complex structure, for example of a housing for receiving further electrical HF components. In other words, the shielding plate that is to be inserted in the opening region can, for example, also be part of a radio or remote radio head that is to be placed on, or can in general be part of other HF electronics assemblies.

The invention claimed is:

1. Capacitively shielded component housing for a mobile communications antenna device, comprising:

an electrically conductive component and/or reflector housing comprising:

an opening region that is shielded from HF radiation by a shielding covering or a shielding plate, and at least two contact or anchoring housing portions, in the shielded state, the shielding covering or the shielding plate being inserted in the opening region of the component and/or reflector housing such that contact or anchoring cover portions on the shielding covering or on the shielding plate extend in parallel with the contact or anchoring housing portions on the component and/or reflector housing, the contact or anchoring housing portions on the component and/or reflector housing and the planar contact or anchoring cover portions of the shielding covering or of the shielding plate being oriented parallel to or obliquely to an insertion or mounting direction (E) and/or to a central axis (Z) that extends through the component and/or reflector housing, at an angle $\alpha$ in accordance with the following condition: $0° \leq \alpha < 90°$, the contact or anchoring cover portions of the shielding covering or of the shielding plate being arranged so as to be directly adjacent to and in a parallel position with respect to the contact or anchoring housing portions on the component and/or reflector housing, with the interposition of an insulation layer, the shielding covering or the shielding plate being capacitively coupled to the component and/or reflector housing, and the shielding covering or the shielding plate being carried and retained by supporting or retaining elements that are anchored in the manner of spacers on the component or reflector housing and comprising projections or pins spaced apart therefrom, which projections or pins are inserted in an associated hole in the shielding covering or in the shielding plate or penetrate holes.

2. The housing according to claim 1, wherein the angle $\alpha$ is $\leq 80°$.

3. The housing according to either claim 1, wherein the shielding covering or the shielding plate is structured to be mounted or dismantled without the use of tools.

4. The housing according to claim 1, wherein the fixing of the shielding covering or the shielding plate is designed to be screw-free.

5. The housing according to claim 1, wherein the holes formed in recessed portions of the shielding covering or of the shielding plate such that the projection or the pin ends below the upper side of the shielding covering or of the shielding plate that is adjacent to the recessed portion.

6. The housing according to claim 1, wherein the holes are made in the component and/or reflector housing, adjacently to the contact and/or anchoring housing portion, so as to be offset from one another in the longitudinal direction, in which holes retaining elements are or can be inserted, without the use of tools, which elements comprise a web that protrudes towards the shielding covering or shielding plate and is formed as a clamping arm or carries a separate clamping arm, such that an adjacent contact or anchoring cover portion can be inserted between the clamping arm and the contact and/or anchoring housing portion and can be brought into a position in parallel with the adjacent contact or anchoring housing portion in a manner force-loaded by the clamping arm.

7. The housing according to claim 6, wherein the retaining elements comprise, on the protruding web, a clamping lever that protrudes and is prestressed towards the contact or anchoring housing portion on the component and/or reflector housing, by which lever, when the shielding covering or shielding plate is placed on, the whole of the associated contact or anchoring cover portions are retained in a manner prestressed towards the contact or anchoring housing portions of the component and/or reflector housing that extend in parallel therewith.

8. The housing according to claim 1, wherein the shielding covering or the shielding plate comprises a separation extending in the longitudinal direction, by which two shielding covering or shielding plate parts or halves are formed, which parts or halves are displaceable relative to one another in the direction transverse to said separation and overlap in a central overlap region, and by which parts or halves the operative width of the shielding covering or of the shielding plate can be adjusted by adjusting the width of the opening region on the component and/or reflector housing.

9. The housing according to claim 8, wherein the two parts or halves can be differently adjusted in the width direction by a limited adjustment mechanism, for which purpose retaining clips are provided that penetrate the two at least partially overlapping holes in the two parts or halves of the shielding covering or of the shielding plate and retain the two parts or halves of the shielding covering or of the shielding plate that overlap in this region in a position in parallel with one another, an insulation layer being provided between the two overlapping portions of the shielding covering or of the shielding plate in order to produce a capacitive coupling.

10. The housing according to either claim 9, wherein the retaining clips are formed in a recessed region in the shielding covering or in the shielding plate such that the anchoring portion of the retaining clips that protrudes in this region is below the surface that otherwise delimits the shielding covering or the shielding plate.

11. The housing according to claim 1 wherein, in the longitudinal direction of the housing, the shielding covering or the shielding plate comprises two portions that are positioned so as to be separated from one another and have a spacing therebetween, in which spacing a power strip is accommodated, and the power strip is covered by a shielding frame, the peripheral flange of which is capacitively coupled by the portions of the shielding covering or the shielding plate located therebelow, while preventing galvanic isolation.

12. The housing according to claim 1, wherein the shielding covering or the shielding plate is part of a further housing structure in which HF electronics or HF electronics components are accommodated.

13. The housing according to claim 1 wherein the shielding covering or the shielding plate is designed such that the orientation position of the associated contact or anchoring cover portions can be adapted in a self-adjusting manner to the orientation position of the contact or anchoring housing portions.

14. A communications antenna device comprising:

an electrically conductive housing comprising an opening region and a first contact or anchoring cover portion;

a shielding covering or plate that shields the opening region from high frequency radiation, the shielding covering or plate being capacitively coupled to the housing, the shielding covering or plate defining holes therethrough and having a second contact or anchoring cover portion;

the shielding covering or plate being inserted into the opening region such that the second contact or anchoring cover portion extends in parallel with the first contact or anchoring housing portion, the first and second contact or anchoring housing portions being oriented relative to an insertion or mounting direction (E) and/or to a central axis (Z) that extends through the housing at an angle $\alpha$ where: $0° \leq \alpha < 90°$;

the first contact or anchoring cover portion being arranged so as to be directly adjacent to and in a parallel position with respect to the second contact or anchoring housing portion;

an insulation layer interposed between the first and second contact or anchoring cover portions; and supporting or retaining elements anchored in the housing, the supporting or retaining elements carrying and retaining the shielding covering or plate, the supporting or retaining elements comprising spaced apart projections or pins inserted into the holes.

* * * * *